US011130016B2

(12) United States Patent
Choi

(10) Patent No.: US 11,130,016 B2
(45) Date of Patent: Sep. 28, 2021

(54) MOVING CYCLIC MACHINE

(71) Applicant: TESFY Co., Ltd., Seoul (KR)

(72) Inventor: Byung Chul Choi, Seoul (KR)

(73) Assignee: TESFY Co., Ltd., Seoul (KR)

( * ) Notice: Subject to any disclaimer, the term of this patent is extended or adjusted under 35 U.S.C. 154(b) by 97 days.

(21) Appl. No.: 16/676,472

(22) Filed: Nov. 7, 2019

(65) Prior Publication Data

US 2021/0008407 A1 Jan. 14, 2021

(30) Foreign Application Priority Data

Jul. 10, 2019 (KR) ..... 10-2019-0083223

(51) Int. Cl.

| | |
|---|---|
| ***A63B 22/00*** | (2006.01) |
| ***A63B 23/04*** | (2006.01) |
| ***A63B 21/00*** | (2006.01) |
| ***A63B 22/06*** | (2006.01) |
| *A63B 21/005* | (2006.01) |

(52) U.S. Cl.

CPC .... *A63B 22/0015* (2013.01); *A63B 21/00058* (2013.01); *A63B 22/0605* (2013.01); *A63B 23/0476* (2013.01); *A63B 21/0058* (2013.01); *A63B 22/0087* (2013.01); *A63B 22/0664* (2013.01); *A63B 2022/0635* (2013.01)

(58) Field of Classification Search

CPC ..... A63B 21/00058; A63B 22/0015; A63B 22/0087; A63B 22/0605; A63B 22/0664; A63B 23/0476; A63B 2022/0092; A63B 2022/0094; A63B 2022/0635

See application file for complete search history.

(56) References Cited

U.S. PATENT DOCUMENTS

| | | | | |
|---|---|---|---|---|
| 7,097,598 | B2 * | 8/2006 | Lee | A63B 22/0012 482/57 |
| 7,393,308 | B1 * | 7/2008 | Huang | A63B 22/001 482/51 |
| 9,360,093 | B2 * | 6/2016 | Garner | F16H 21/50 |
| 10,039,951 | B2 * | 8/2018 | Chang | A63B 22/0605 |
| 2007/0238584 | A1 * | 10/2007 | Lee | A63B 22/0605 482/57 |
| 2009/0197744 | A1 * | 8/2009 | Yamazaki | A63B 22/18 482/57 |

FOREIGN PATENT DOCUMENTS

| | | |
|---|---|---|
| CN | 102743833 A | 10/2012 |
| JP | 2019-025079 A | 2/2019 |

(Continued)

OTHER PUBLICATIONS

International Search Report dated Aug. 14, 2020 for PCT/KR2020/005443.

*Primary Examiner* — Megan Anderson
(74) *Attorney, Agent, or Firm* — Seung Ho Lee

(57) ABSTRACT

Disclosed is a moving cyclic machine which is implemented to perform an elliptical motion or interpolating curve motion independently from pedal rotation in a mechanical aspect so as to remedy boredom and improve a difficult exercise process of existing cycle exercise and to provide interest and motivation by increasing a level of a sense of immersion such that a user can continuously do lower body exercise and aerobic exercise for a long time everyday.

15 Claims, 6 Drawing Sheets

(56) References Cited

FOREIGN PATENT DOCUMENTS

| | | | |
|---|---|---|---|
| KR | 20-0299481 | Y1 | 1/2003 |
| KR | 10-2003-0072945 | A | 9/2003 |
| KR | 10-2004-0021916 | A | 3/2004 |
| KR | 10-1497381 | B | 3/2015 |
| KR | 10-2016-0090003 | A | 7/2016 |

* cited by examiner

MOVING CYCLIC MACHINE

CROSS-REFERENCE TO RELATED APPLICATION

This application claims priority to and the benefit of Korean Patent Application No. 10-2019-0083223, filed on Jul. 10, 2019, the disclosure of which is incorporated herein by reference in its entirety.

BACKGROUND

1. Field of the Invention

The present invention relates to health technology, and more particularly, to a moving cyclic machine configured to increase muscular strength of a lower body and do aerobic exercise.

2. Discussion of Related Art

Korean Utility Model Registration No. 20-0299481 (Dec. 16, 2002) discloses a horse-riding health cycle in which when a rotating force is transferred to a front rotating wheel by pedaling with pedals, a rotary motion of a cam fixed to the rotating wheel is converted into a vertical motion of a lever and a saddle vertically moves such that the saddle vertically moves as in horse riding so as to perform aerobic exercise through the vertical motion of the saddle while riding the bicycle on a road.

In conventional health bicycles, since a saddle uniformly performs vertical motion according to pedal rotation, cycle exercise may be a boring and difficult process. Accordingly, the present inventor has done research on a moving cyclic machine which is implemented to allow a saddle to perform an elliptical motion or interpolating curve motion independently from pedal rotation in a mechanical aspect so as to remedy boredom and a difficult process of an existing cycling exercise.

RELATED ART DOCUMENT

Patent Document

Korean Utility Model Registration No. 20-0299481 (Dec. 16, 2002)

SUMMARY OF THE INVENTION

The present invention is directed to providing a moving cyclic machine which is implemented to allow a saddle to perform an elliptical motion or interpolating curve motion independently from pedal rotation in a mechanical aspect so as to remedy boredom and a difficult process of an existing cycling exercise.

According to an aspect of the present invention, there is provided a moving cyclic machine including a pair of pedals performing a rotary motion, a magnetic disc driven by the pedals to rotate, a motor generating an additional rotating force independent from pedal rotation, a saddle not driven according to the pedal rotation and configured to perform an elliptical motion or interpolating curve motion due to the rotating force generated by the motor, and a control portion configured to control revolutions per minute (RPM) of the motor.

The control portion may control the RPM of the motor in real time according to a magnitude of a magnetic field according to RPM of the magnetic disc.

The moving cyclic machine may further include a magnetic detection sensor which detects a magnetic field magnitude variation according to the RPM of the magnetic disc in real time.

The control portion may control the RPM of the motor in real time according to a voltage variation of a piezoelectric module according to exercise intensity of pedaling.

The control portion may control the RPM of the motor in real time according to a tempo variation of music content data.

The control portion may control the RPM of the motor in real time according to exercise plan data scheduled in an exercise program.

The control portion may control the RPM of the motor in real time according to physical strength data of a user.

The moving cyclic machine may further include a memory which stores data.

The moving cyclic machine may further include a front handle and a rear handle. Here, the control portion may recognize a grip of a user with respect to the front handle or the rear handle and control the motor to rotate.

The moving cyclic machine may further include a gripping thigh exercise device which is folded when user's thighs are tightened.

The thigh exercise device may include a contact wing portion which comes into contact with an inner side of each of both thighs of the user and a resistance providing portion which provides resistance against the user's thighs when the contact wing portion is folded by the user's thighs.

The resistance providing portion may include a resistance wheel driven to rotate when the contact wing portion is folded by the user's thighs.

The thigh exercise device may further include a motion conversion portion which converts a linear motion of the contact wing portion into a rotary motion of the resistance wheel.

The moving cyclic machine may further include a saddle tilting portion which tilts a left side or right side of the saddle down according to leftward or rightward rotation of the front handle.

The saddle tilting portion may include a rotating bar configured to rotate leftward or rightward according to leftward or rightward rotation of the front handle, two variable motion conversion portions configured to convert rotation of the rotating bar into a reciprocating motion while one sides thereof are elongated and other sides are contracted according to rotation of the rotating bar, and a tilting driving portion configured to tilt the left side or right side of the saddle downwards according to extendibility and contractibility generated by the two variable motion conversion portions.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
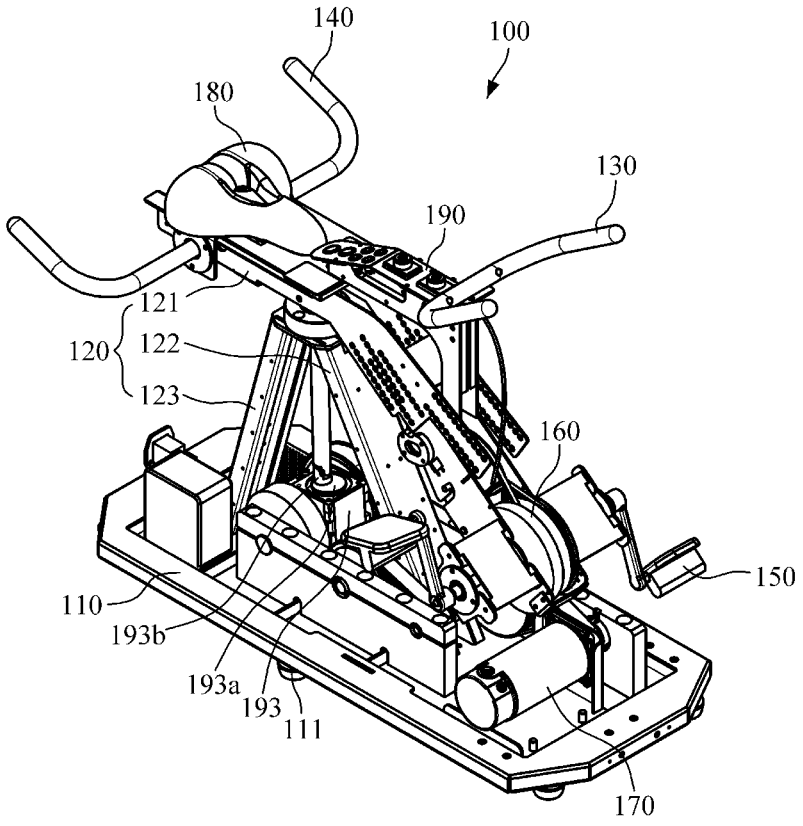
FIG. 1 is a perspective view of a moving cyclic machine according to the present invention.

Hereinafter, exemplary embodiments of the present invention will be described in detail with reference to the attached drawings to allow those skilled in the art to easily understand and reproduce the present invention. Although particular embodiments are illustrated in the drawings and a detailed description related thereto is disclosed, these are not intended to limit a variety of embodiments of the present invention to the particular forms.

In a description of the present invention, a detailed description of well-known functions or components of the related art will be omitted when it is deemed to obscure the essence of the present invention.

When it is stated that one component is "connected" or "joined" to another component, it should be understood that the one component may be directly connected or joined to the other component but another component may be present therebetween.

On the other hand, when it is described that one component is "directly connected" or "directly joined" to another component, it should be understood that no other component is present therebetween.

Figure 2:
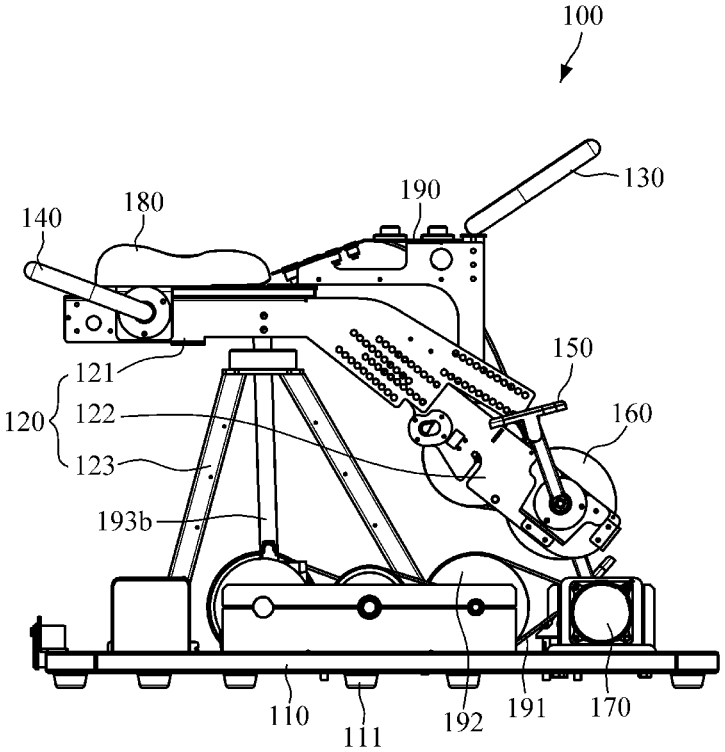
FIG. 2 is a side view of the moving cyclic machine according to the present invention.
Figure 3:
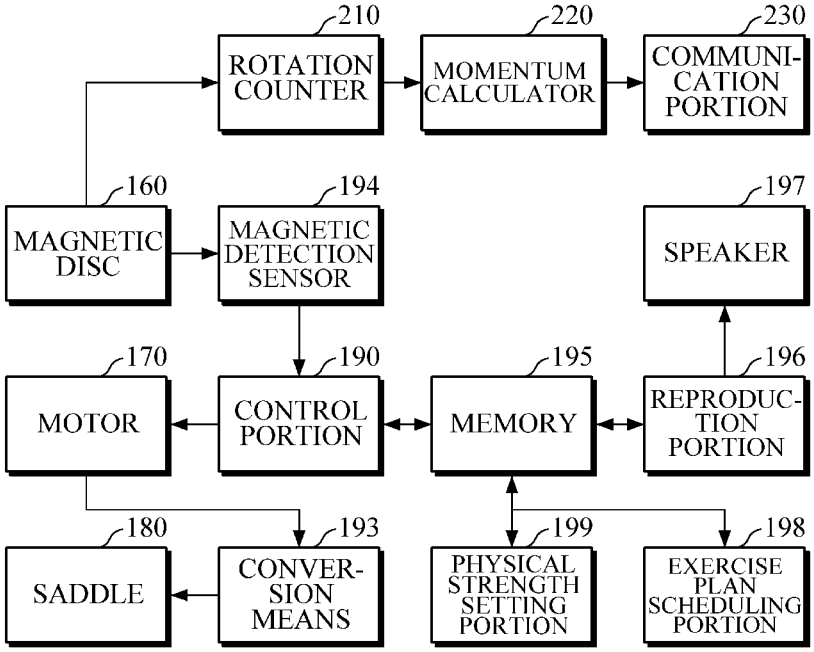
FIG. 3 is a block diagram illustrating components of an example of the moving cyclic machine according to the present invention.

FIG. 1 is a perspective view of a moving cyclic machine according to the present invention, FIG. 2 is a side view of the moving cyclic machine according to the present invention, and FIG. 3 is a block diagram illustrating components of an example of the moving cyclic machine according to the present invention.

As shown in the drawings, a moving cyclic machine 100 according to the present invention includes a base body 110 supported by the ground, a frame body 120 formed above the base body 110, a front handle 130 formed in front of and above the frame body 120, and a rear handle 140 formed behind and above the frame body 120.

Also, independently from rotation of pedals in a mechanical aspect, a saddle is implemented to perform elliptic motion or interpolating curve motion such that a cycle exercise is not uniform and is prevented from boring. To this end, the moving cyclic machine 100 according to the present invention includes a pair of pedals 150, a magnetic disc 160, a motor 170, a saddle 180, and a control portion 190.

The base body 110 may be a metallic or nonmetallic material and have a plurality of movement-preventing devices 111 in a lower portion thereof, which is formed of a material such as a rubber, to prevent the moving cyclic machine 100 from moving from the ground.

The frame body 120 is coupled to a top of the base body 110 and includes an upper frame 121, a lower front frame 122, and a lower rear frame 123. The front handle 130, the rear handle 140, the saddle 180, and the control portion 190 are installed on the upper frame 121, and the pair of pedals 150 and the magnetic disc 160 are installed on the lower front frame 122.

The front handle 130 is installed in front of the upper frame 121 of the frame body 120 such that a user grips both ends of the front handle 130 and does aerobic exercise using the moving cyclic machine 100 while bending the body forward.

The rear handle 140 is installed to the rear of the upper frame 121 of the frame body 120 such that a user grips both ends of the rear handle 140 and does aerobic exercise using the moving cyclic machine 100 while stretching the body backward.

The pair of pedals 150 are installed on the lower front frame 122 of the frame body 120 and perform a rotational motion when the user pedals therewith using his or her feet. The pair of pedals 150 may be generally implemented to have an unaligned structure but is not limited thereto.

The magnetic disc 160 is installed on the lower front frame 122 of the frame body 120 and rotationally driven by the pedals 150. Here, it is unnecessary for an entirety of the magnetic disc 160 to be a magnet. A part of the magnetic disc 160 having a circular disc shape may be a permanent magnet or a permanent magnet may be attached to a part the magnetic disc 160.

The motor 170 may be installed above a front part of the base body 110 and generates an additional rotation force independent from the rotation of the pedals 150. Here, the motor 170 may be implemented to transfer torque to the saddle 180 through a belt 191, a rotating gear 192, and the like.

The saddle 180 is not driven according to pedal rotation and performs elliptical motion or interpolating curve motion according to a rotational driving force generated by the motor 170. Here, the torque of the motor 170 may be converted into the elliptical motion or interpolating curve motion of the saddle 180 through a conversion means 193. For example, the conversion means 193 may include a cam 193*a* which converts the rotary motion into a reciprocating motion and a universal joint 193*b* which converts the reciprocating motion into an elliptical motion or interpolating curve motion but is not limited thereto.

The control portion 190 may be installed on the upper frame 121 and the like of the frame body 120 and controls an entirety of the moving cyclic machine including controlling revolutions per minute (RPM) of the motor. For example, the control portion 190 may be implemented as a form in which a chip or circuit controlling the entirety of the moving cyclic machine including controlling of RPM of the motor is modulated on a printed circuit board (PCB).

Being implemented as described above, in the present invention, the saddle may perform an elliptical motion or interpolating curve motion by generating torque that is adequately controlled in real time according to a service environment through the motor 170 which is an additional rotational driving means separate from the rotation of the pedals 150 of the moving cyclic machine 100.

Accordingly, in the present invention, the saddle performs the elliptical motion or the interpolating curve motion independently in a mechanical aspect from the rotation of the pedals 150 of the moving cyclic machine 100 so as to relieve the boredom of uniform cycle motion and to steadily continue a difficult process of lower-body exercise and aerobic motion.

Meanwhile, according to an additional aspect of the present invention, the control portion 190 may be implemented to control RPM of the motor 170 in real time according to a magnetic field magnitude according to RPM of the magnetic disc 160.

To this end, the moving cyclic machine 100 may further include a magnetic detection sensor 194 which detects a magnetic field magnitude variation according to RPM of the magnetic disc 160 in real time.

When the user pedals with the pedals 150 of the moving cyclic machine 100, the magnetic disc 160 rotates and a magnetic field magnitude variation caused by RPM of the magnetic disc 160 is detected in real time by the magnetic detection sensor 194. When the motor is driven while RPM of the motor 170 is controlled by the control portion 190 in real time according to a detected magnetic field magnitude, a motion velocity of the elliptical motion or the interpolating curve motion of the saddle 180 is changed in real time.

That is, in the embodiment, the motion velocity of the elliptical motion or interpolating curve motion of the saddle 180 increases as the user pedals faster with the pedals 150 of the moving cyclic machine 100 and the motion velocity decreases as the user pedals slower with the pedals 150 such that a change is given thereto and cycling motion is not uniform so as to prevent the user from being bored.

Meanwhile, according to an additional aspect of the present invention, the control portion 190 may be implemented to control, in real time, RPM of the motor according to a voltage variation of a piezoelectric module according to pedaling motion intensity.

That is, in the embodiment, a piezoelectric module (not shown) is installed on the pedal 150 of the moving cyclic machine 100 and the control portion 190 is implemented to control, in real time, RPM of the motor using a piezoelectric phenomenon in which a pressure applied to the piezoelectric modules increases as the user pedals more strongly with the pedals 150 of the moving cyclic machine 100 such that a voltage output from the piezoelectric module increases.

Meanwhile, according to an additional aspect of the present invention, the control portion 190 may be implemented to control, in real time, RPM of the motor 170 according to a tempo variation of music content data. For example, music content may have a rapid tempo variation such as dance music and the like.

To this end, the moving cyclic machine 100 may further include a memory 195 storing music content data, a reproduction portion 196 which reads and reproduces the music content data stored in the memory 195, and a speaker 197 which outputs music reproduced by the reproduction portion 196. Here, when the music content data is multimedia data, a display device (not shown) which outputs the multimedia data on a screen may be further included.

When the user reproduces music content, the control portion 190 drives the motor 170 while controlling RPM of the motor 170 in real time according to a tempo variation of the reproduced music content. Then, the motion velocity of the elliptical motion or interpolating curve motion of the saddle 180 is changed in real time.

That is, in the embodiment, while the user does aerobic exercise and listens to music through the moving cyclic machine 100, the motion velocity of the elliptical motion or to interpolating curve motion of the saddle 180 increases as a tempo of music content data becomes faster and the motion velocity decreases as the tempo becomes slower such that a change is given thereto and cycling motion is not uniform so as to prevent the user from being bored.

Meanwhile, according to an additional aspect of the present invention, the control portion 190 may be implemented to control, in real time, RPM of the motor 170 according to exercise plan data scheduled in an exercise program. For example, the exercise plan data may be scheduled by the user operating the exercise program.

To this end, the moving cyclic machine 100 may further include a memory 195 which stores an exercise program and exercise plan data and an exercise plan scheduling portion 198 which schedules an exercise plan by executing the exercise program and stores exercise plan data in the memory 195.

When the user schedules an exercise plan through the exercise plan scheduling portion 198 of the moving cyclic machine 100 and stores exercise plan data in the memory 195, the control portion 190 drives the motor 170 while controlling RPM of the motor 170 in real time according to the scheduled exercise plan data. Then, the motion velocity of the elliptical motion or interpolating curve motion of the saddle 180 is changed in real time.

That is, in the embodiment, a change is given to increase or decrease the motion velocity of the elliptical motion or interpolating curve motion of the saddle 180 according to the exercise plan scheduled by the user so as to prevent the cycling motion from being uniform and to prevent the user from being bored.

A detailed example of the scheduled exercise program will be as follows.

1) In a program mode, when a user starts a pedaling motion at a certain velocity, pedal intensity gradually increases or decreases alternately due to a set program such that "movement of moving" becomes faster or slower according thereto.

2) Although the pedaling intensity increases and it becomes difficult to pedal, it is unnecessary for the user to reduce a speed of pedaling while concentrating on "a moderate tempo of moving velocity" of moving an entire body.

3) A sense of accomplishment in pleasant exercise is experienced with thigh muscles which feel stiff due thereto.

4) Accordingly, the user immerses him or herself in difficult exercise for 30 minutes or more and will gladly do exercise the next day.

FIGS. 6A, 6B, 6C and 6D illustrate a variety of programs which a user may select according to his or her physical strength and preference according to the present invention. The user may select one of a variety of programs illustrated in FIGS. 6A, 6B, 6C and 6D according to his or her physical strength and preference.

Figure 6A:
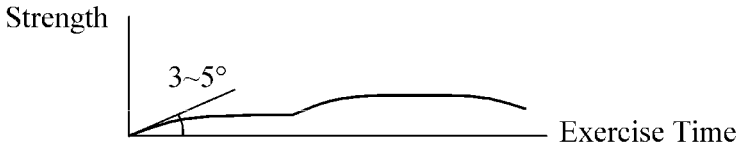
FIGS. 6A, 6B, 6C and 6D illustrate a variety of programs which a user may select according to his or her physical strength and preference according to the present invention.

Regular 1 (for example, average physical strength level of female student in eighth grade): pedaling intensity within a range of 3 to 5°, as illustrated in FIG. 6A.

Figure 6B:
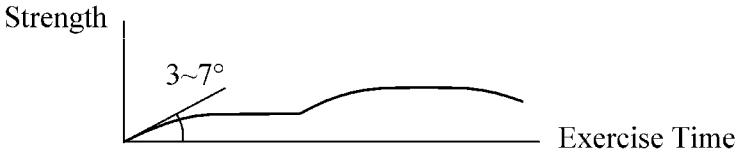

Regular 2 (for example, average physical strength level of male over 65): pedaling intensity within a range of 3 to 7°, as illustrated in FIG. 6B.

Figure 6C:
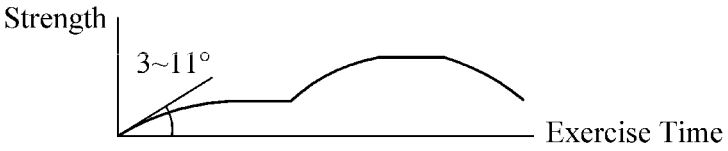

Advanced 1 (for example, men in their forties): pedaling level within a range of 3 to 11°, as illustrated in FIG. 6C.

Figure 6D:
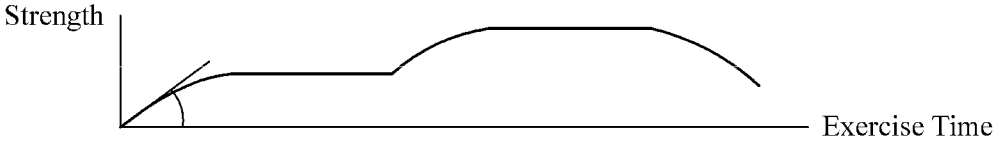

Advanced 2 (for example, men in their twenties and thirties): pedaling level within a range of 3 to 13°, as illustrated in FIG. 6D.

Meanwhile, according to an additional aspect of the present invention, the control portion 190 may be implemented to control, in real time, RPM of the motor 170 according to physical strength data of the user. Here, the physical strength data of the user may be data classified, for example, into high, medium, and low.

To this end, the moving cyclic machine 100 may further include a memory 195 which stores physical strength data of the user and a physical strength setting portion 199 which sets physical strength of the user and stores physical strength data of the user in the memory 195.

When the user sets physical strength of the user through the physical strength setting portion 199 of the moving cyclic machine 100 and stores physical strength data of the user in the memory 195, the control portion 190 drives the motor 170 while controlling RPM of the motor 170 in real time according to the physical strength data of the user. Then, the motion velocity of the elliptical motion or interpolating curve motion of the saddle 180 is changed in real time.

That is, in the embodiment, the motion velocity of the elliptical motion or interpolating curve motion of the saddle 180 is adjusted according to the physical strength of the user so as to prevent the cycling motion from being uniform and to prevent the user from being bored.

Meanwhile, according to an additional aspect of the present invention, the moving cyclic machine 100 may further include a rotation counter 210 which counts a rotation number of the magnetic disc 160, a momentum calculator 220 which calculates momentum of a user from the rotation number of the magnetic disc 160 which is counted by the rotation counter 210, and a wireless communication portion 230 which wirelessly transmits the momentum of the user calculated by the momentum calculator 220 to a user's mobile terminal and the like possessed by the user to be implemented to allow the user to recognize the momentum of the user through the user's mobile terminal and the like.

Meanwhile, according to an additional aspect of the present invention, the control portion 190 may recognize a grip of the user with respect to the front handle 130 or the rear handle 140 and control the motor 170 to rotate.

That is, in the embodiment, the moving cyclic machine 100 is implemented to drive the motor 170 to rotate only when the user grips the front handle 130 or the rear handle 140 with his or her hands so as to prevent an accident of the user falling from the moving cyclic machine 100.

Here, a grip sensor (not shown) may be mounted in each of the front handle 130 and the rear handle 140 in order to recognize a grip of the user with respect to the front handle 130 or the rear handle 140. For example, the grip sensor may be a capacitive pressure sensor but is not limited thereto.

Figure 4:
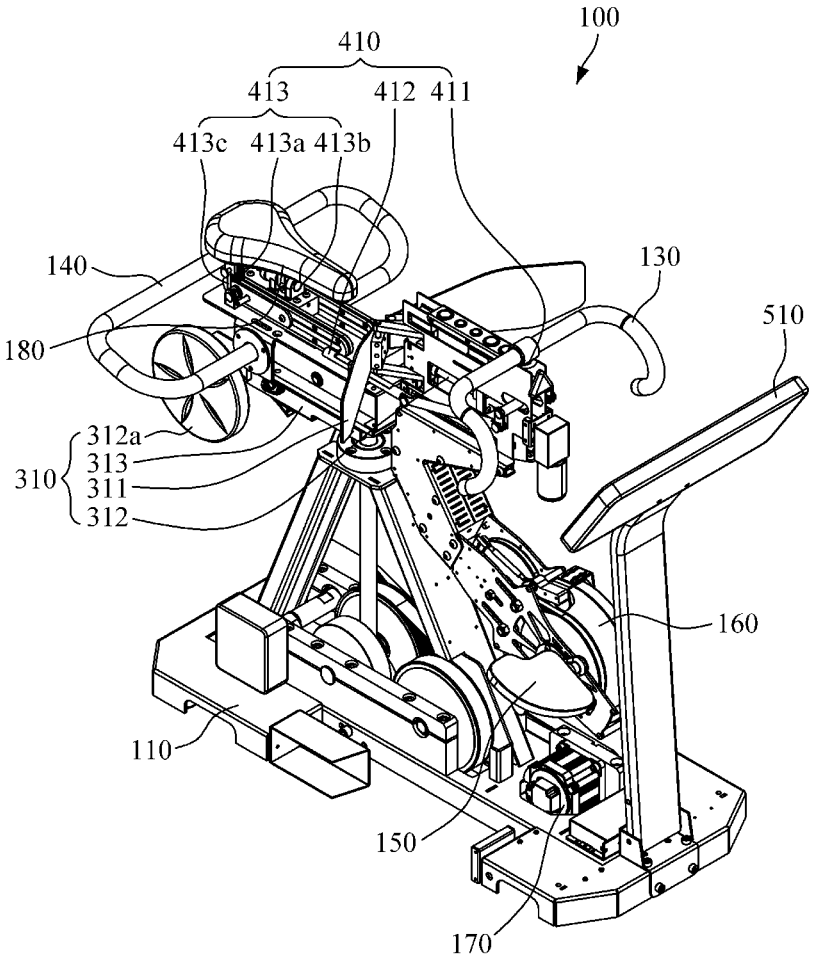
FIG. 4 is a perspective view illustrating another embodiment of the moving cyclic machine according to the present invention.
Figure 5:
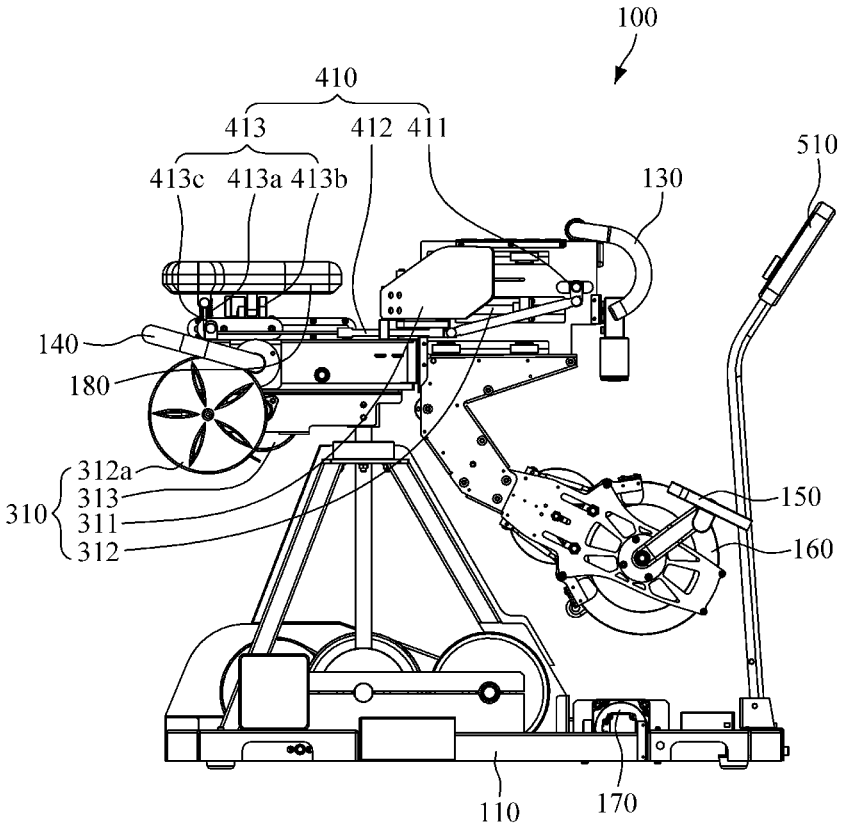
FIG. 5 is a side view illustrating still another embodiment of the moving cyclic machine according to the present invention.

FIG. 4 is a perspective view illustrating another embodiment of the moving cyclic machine according to the present invention, and FIG. 5 is a side view illustrating still another embodiment of the moving cyclic machine according to the present invention. The embodiments shown in FIGS. 4 and 5 further include a thigh exercise function and a saddle tilting function in addition to the embodiment shown in FIGS. 1 to 3.

As shown in FIGS. 4 and 5, the moving cyclic machine according to the embodiments may further include a thigh exercise device 310. The thigh exercise device 310 is a gripping-type exercise device which is folded while user's thighs are tightened. For example, the thigh exercise device 310 may include a contact wing portion 311 and a resistance providing portion 312.

The contact wing portion 311 comes into contact with an inside of each of the user's thighs. For example, the contact wing portion 311 may be implemented to be folded forward by a force when the user's thighs are tightened.

The resistance providing portion 312 provides resistance to the user's thighs to allow the user's thighs to exercise when the contact wing portion 311 is folded by the user's thighs. The resistance providing portion 312 provides resistance against a force generated when the contact wing portion 311 is folded forward by the user's thighs.

For example, the resistance providing portion 312 may include a resistance wheel 312*a* driven to rotate when the contact wing portion 311 is folded by the user's thighs. Efficiency of thigh exercise of the user may be increased by adjusting tension of the resistance wheel 312*a* or replacing the resistance wheel 312*a* with another resistance wheel having a different weight according to a degree of the thigh exercise of the user.

Meanwhile, the contact wing portion 311 may be implemented to be unfolded backward and restored when the user's thighs are spaced apart from the contact wing portion 311 while the contact wing portion 311 is folded forward.

Meanwhile, according to an additional aspect of the present invention, the thigh exercise device 310 may further include a motion conversion portion 313. The motion conversion portion 313 converts a linear motion of the contact wing portion 311 into a rotary motion of the resistance wheel 312*a*. For example, the motion conversion portion 313 may be implemented by combining a plurality of exercise conversion means such as a gear, a crank, a cam, a pulley, and the like.

When the contact wing portion 311 is folded by the user's thighs and a linear motion occurs forward, the motion conversion portion 313 converts the linear motion into a rotary motion and drives the resistance wheel 312*a* to rotate so as to provide resistance for exercise of the user's thighs.

Meanwhile, according to another aspect of the present invention, the moving cyclic machine may further include a saddle tilting portion 410. The saddle tilting portion 410 tilts a left side or a right side of the saddle 180 down according to leftward or rightward rotation of the front handle 130. For example, the saddle tilting portion 410 may include a rotating bar 411, two variable motion conversion portions 412, and a tilting driving portion 413.

The rotating bar 411 rotates leftward or rightward according to leftward or rightward rotation of the front handle 130. For example, the rotating bar 411 may be implemented to be coupled with a bottom end of a central portion of the front handle 130 and to rotate leftward or rightward according to the leftward or rightward rotation of the front handle 130.

The two variable motion conversion portions 412 convert rotation of the rotating bar 411 into a reciprocating motion while one sides thereof are elongated and other ends thereof are contracted according to the rotation of the rotating bar 411. For example, the two variable motion conversion portions 412 may be implemented by combining a plurality of exercise conversion means such as a gear, a crank, a cam, a pulley, and the like.

The tilting driving portion 413 tilts the left side or right side of the saddle 180 downwards according to extendibility and contractibility through the two variable motion conversion portions 412. For example, the tilting driving portion 413 may include a spring 413*a*, a rotating member 413*b*, and a driving member 413*c*.

The spring 413*a* is installed below the saddle 180 and provides an elastic force to tilt the saddle 180. The rotating member 413*b* rotates the left side or right side of the saddle 180 down. The driving member 413*c* is connected to each of both sides of the saddle 180 and pulls the left side or right side of the saddle 180 down due to a contraction operation of the two variable motion conversion portions 412.

When the front handle 130 rotates leftward or rightward such that the rotating bar 411 rotates leftward or rightward, the variable motion conversion portions 412 on both sides are elongated and contracted and apply extendibility and contractibility to the tilting driving portion 413 such that the tilting driving portion 413 gives the user a sense of cornering by tilting the left side or right side of the saddle 180 down.

Meanwhile, in FIGS. 4 and 5, an unstated reference numeral 510 is a user interface portion including a user manipulating button or a screen output means.

As described above, according to the present invention, independently from pedal rotation of a moving cyclic machine in a mechanical aspect, a saddle is implemented to perform an elliptical motion or interpolating curve motion such that a cycling motion is not uniform and is prevented from boring so as to arouse a user's interest to continuously perform aerobic exercise.

Also, according to the present invention, since not only may a user do thigh exercise according to using the moving cyclic machine but also a sense of cornering may be given to the user according to manipulation of the user with respect to a front handle, effects of exercise and creating interest in the user may be further increased using the moving cyclic machine.

According to the present invention, a moving cyclic machine is implemented such that a saddle performs an elliptical motion or interpolating curve motion according to a rotational driving force generated by a motor independent from pedal rotation in a mechanical aspect so as to provide an effect of remedying boredom and improving a difficult process of existing uniform cycle exercise.

In more detail, since an exercise process is necessary for an adequate time for lower body muscle exercise and aerobic exercise, a scheduled program of the moving cyclic machine provides an effect of allowing a user to continuously do lower body exercise and aerobic exercise for a long time by providing a sense of immersion and motivation to allow the user to be capable of performing the difficult exercise according to a target of a certain momentum.

A variety of embodiments disclosed in the specification and drawings are merely particular examples to help understanding and not intended to limit the scope of the variety of embodiments of the present invention.

Accordingly, the scope of the variety of the present invention should be interpreted as including all changes or modifications derived on the basis of the technical concept of the variety of embodiments of the present invention in addition to the above-described embodiments.

What is claimed is:

1. A moving cyclic machine comprising:

a pair of pedals configured to perform a rotary motion;

a magnetic disc driven by the pair of pedals;

a motor configured to generate an additional rotating force independent from pedal rotation;

a saddle not driven by rotation of the pair of pedals and the saddle configured to perform an elliptical motion or interpolating curve motion according to the rotating force generated by the motor; and a control portion configured to control revolutions per minute (RPM) of the motor.

2. The moving cyclic machine of claim 1, further comprising a gripping thigh exercise device which is configured to be folded when user's thighs are tightened.

3. The moving cyclic machine of claim 2, wherein the gripping thigh exercise device comprises:

a contact wing portion which comes into contact with an inner side of both thighs of the user; and a resistance providing portion which provides resistance against the user's thighs when the contact wing portion is folded by the user's thighs.

4. The moving cyclic machine of claim 3, wherein the resistance providing portion comprises a resistance wheel driven to rotate when the contact wing portion is folded by the user's thighs.

5. The moving cyclic machine of claim 4, wherein the gripping thigh exercise device further comprises a motion conversion portion which converts a linear motion of the contact wing portion into a rotary motion of the resistance wheel.

6. The moving cyclic machine of claim 1, further comprising a front handle and a rear handle, wherein the control portion is configured to recognize a grip of a user with respect to the front handle or the rear handle and controls the motor to rotate.

7. The moving cyclic machine of claim 6, further comprising a saddle tilting portion which tilts a left side or right side of the saddle down according to leftward or rightward rotation of the front handle.

8. The moving cyclic machine of claim 7, wherein the saddle tilting portion comprises:

a rotating bar configured to rotate leftward or rightward according to leftward or rightward rotation of the front handle;

two variable motion conversion portions configured to convert rotation of the rotating bar into a reciprocating motion while one sides thereof are elongated and other sides are contracted according to rotation of the rotating bar; and a tilting driving portion configured to tilt the left side or right side of the saddle downwards according to extendibility and contractibility generated by the two variable motion conversion portions.

9. The moving cyclic machine of claim 1, wherein the control portion is configured to control the RPM of the motor in real time according to a magnitude of a magnetic field according to RPM of the magnetic disc.

10. The moving cyclic machine of claim 9, further comprising a magnetic detection sensor which is configured to detect a magnetic field magnitude variation according to the RPM of the magnetic disc in real time.

11. The moving cyclic machine of claim 1, wherein the control portion is configured to control the RPM of the motor in real time according to a voltage variation of a piezoelectric module according to exercise intensity of pedaling.

12. The moving cyclic machine of claim 1, wherein the control portion is configured to control the RPM of the motor in real time according to a tempo variation of music content data.

13. The moving cyclic machine of claim 1, wherein the control portion is configured to control the RPM of the motor in real time according to exercise plan data scheduled in an exercise program.

14. The moving cyclic machine of claim 1, wherein the control portion is configured to control the RPM of the motor in real time according to physical strength data of a user.

15. The moving cyclic machine of claim 1, further comprising a memory which stores data.

* * * * *